US010799894B2

(12) United States Patent
Kinne et al.

(10) Patent No.: US 10,799,894 B2
(45) Date of Patent: Oct. 13, 2020

(54) SPRAY TIP

(71) Applicant: Graco Minnesota Inc., Minneapolis, MN (US)

(72) Inventors: Robert W. Kinne, Columbia Heights, MN (US); Pamela J. Muetzel, Maple Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 202 days.

(21) Appl. No.: 15/855,474

(22) Filed: Dec. 27, 2017

(65) Prior Publication Data

US 2018/0178228 A1 Jun. 28, 2018

Related U.S. Application Data

(60) Provisional application No. 62/439,839, filed on Dec. 28, 2016.

(51) Int. Cl.
*B05B 7/02* (2006.01)
*B05B 1/02* (2006.01)
(Continued)

(52) U.S. Cl.
CPC ..... *B05B 7/02* (2013.01); *B05B 1/02* (2013.01); *B05B 1/048* (2013.01); *B05B 1/341* (2013.01); *B05B 9/0861* (2013.01)

(58) Field of Classification Search
CPC ..... B05B 1/02; B05B 1/048; B05B 1/341; B05B 9/0861; B05B 13/04; B05B 15/40;
(Continued)

(56) References Cited

U.S. PATENT DOCUMENTS 3,843,052 A 10/1974 Cowan
3,865,314 A 2/1975 Levey et al.
(Continued)

FOREIGN PATENT DOCUMENTS

CN 1115692 A 1/1996
CN 105531033 A 4/2016
(Continued)

OTHER PUBLICATIONS

Extended European Search Report for European Patent Application No. 17210925.8, dated Sep. 21, 2018, 8 pages.
(Continued)

*Primary Examiner* — Arthur O. Hall
*Assistant Examiner* — Juan C Barrera
(74) *Attorney, Agent, or Firm* — Kinney & Lange, P.A.

(57) ABSTRACT

A spray tip includes a body portion with an aperture extending through the body portion from an aperture inlet to an aperture outlet, and a handle portion attached to the body portion. The handle portion is configured to rotate the body portion. A retainer with an upstream end and a downstream end is positioned in the aperture of the body portion. A pre-orifice piece with an upstream end and a downstream end is positioned in the aperture of the body portion. A tip piece with an upstream end and a downstream end is positioned in the aperture of the body portion. The downstream end comprises an outlet nozzle.

20 Claims, 8 Drawing Sheets

(51) Int. Cl.
*B05B 1/34* (2006.01)
*B05B 1/04* (2006.01)
*B05B 9/08* (2006.01)

(58) Field of Classification Search
CPC .... B05B 1/1672; B05B 1/34; B05B 7/02–129
USPC ..... 239/589
See application file for complete search history.

(56) References Cited

U.S. PATENT DOCUMENTS 3,930,619 A 1/1976 Levey et al.
4,072,270 A 2/1978 Harmony
4,074,857 A 2/1978 Calder
4,165,836 A 8/1979 Eull
5,178,325 A 1/1993 Nielsen
5,275,340 A 1/1994 Haruch
5,294,053 A 3/1994 Perret, Jr.
5,333,794 A 8/1994 Haruch
5,505,381 A * 4/1996 Torntore ..... B05B 15/534 239/119
5,749,528 A * 5/1998 Carey ..... B05B 15/534 239/119
5,810,256 A 9/1998 Perret
5,887,793 A 3/1999 Kieffer
6,036,116 A 3/2000 Bui
6,264,115 B1 7/2001 Liska et al.
6,390,386 B2 5/2002 Krohn et al.
6,702,198 B2 3/2004 Tam et al.
2002/0014541 A1* 2/2002 Krohn ..... B05B 15/534 239/119
2004/0195354 A1 10/2004 Leisi
2007/0102535 A1* 5/2007 Carey ..... B05B 15/534 239/74
2015/0273494 A1 10/2015 Koehne et al.
2016/0228883 A1* 8/2016 Becker ..... B05B 1/341

FOREIGN PATENT DOCUMENTS

GB 2288348 A 10/1995
WO WO2009147443 A2 12/2009
WO WO2009147443 A3 12/2009
WO WO2015039078 A1 3/2015

OTHER PUBLICATIONS

First Chinese Office Action for Chinese Patent Application No. 2017114499790, dated Dec. 2, 2019, 25 pages.

* cited by examiner

SPRAY TIP

CROSS-REFERENCE TO RELATED APPLICATION(S)

This application claims priority to U.S. Provisional Application No. 62/439,839, filed on Dec. 28, 2016, and entitled "Spray Tip," the disclosure of which is incorporated by reference in its entirety.

BACKGROUND

The present disclose relates to fluid spraying systems, and in particular, to a spray tip for fluid spraying systems.

Fluid spraying systems are commonly used in a wide variety of applications, from industrial assembly to home painting. Handheld paint sprayers can be used by a human operator, while automated sprayers are typically used in mechanized manufacturing processes. Fluid sprayed by such systems conforms to a spray pattern defined, in large part, by aperture shape and size. Different spray tips, with different aperture shapes and sizes, can be positioned in fluid spraying systems to alter the spray pattern of the fluid being sprayed by the fluid spraying system.

SUMMARY

A spray tip includes a body portion with an aperture extending through the body portion from an aperture inlet to an aperture outlet, and a handle portion attached to the body portion. The handle portion is configured to rotate the body portion. A retainer with an upstream end and a downstream end is positioned in the aperture of the body portion. The retainer includes a retainer passage extending from the upstream end to the downstream end of the retainer. A pre-orifice piece with an upstream end and a downstream end is positioned in the aperture of the body portion. The pre-orifice piece includes a pre-orifice piece passage extending from the upstream end to the downstream end of the pre-orifice piece. The pre-orifice piece passage being defined by a recess on the upstream end, an expansion chamber portion on the downstream end, and a pre-orifice located downstream of the recess and upstream of the expansion chamber portion. The pre-orifice is a narrowest portion of the pre-orifice piece passage. A tip piece with an upstream end and a downstream end is positioned in the aperture of the body portion. The tip piece includes a tip piece passage extending form the upstream end to the downstream end of the tip piece. The downstream end comprises an outlet nozzle.

A spray tip includes a body portion with an aperture extending through the body portion from an aperture inlet to an aperture outlet, and a handle portion attached to the body portion. The handle portion is configured to rotate the body portion. A retainer with an upstream end and a downstream end is positioned in the aperture of the body portion. The retainer includes a retainer passage extending from the upstream end to the downstream end of the retainer. A pre-orifice piece with an upstream end and a downstream end positioned in the aperture of the body portion. The pre-orifice piece includes a pre-orifice piece passage extending from the upstream end to the downstream end of the pre-orifice piece. The pre-orifice piece passage includes an expansion chamber portion with a downstream end aligned with the downstream end of the pre-orifice piece. A tip piece with an upstream end and a downstream end positioned in the aperture of the body portion. The tip piece includes a tip piece passage extending form the upstream end to the downstream end of the tip piece. The downstream end comprises an outlet nozzle. The tip piece passage includes an expansion chamber portion with an upstream end aligned with the upstream end of the tip piece. The diameter of the expansion chamber portion of the pre-orifice piece passage at the downstream end is larger than the diameter of the expansion chamber portion of the tip piece passage at the upstream end A set of spray tips, each spray tip includes a body portion with an aperture extending through the body portion from an aperture inlet to an aperture outlet, and a handle portion attached to the body portion. The handle portion is configured to rotate the body portion. A retainer with an upstream end and a downstream end is positioned in the aperture of the body portion. The retainer includes a retainer passage extending from the upstream end to the downstream end of the retainer. A pre-orifice piece with an upstream end and a downstream end positioned in the aperture of the body portion. The pre-orifice piece includes a pre-orifice piece passage extending from the upstream end to the downstream end of the pre-orifice piece. A tip piece with an upstream end and a downstream end positioned in the aperture of the body portion. The tip piece includes a tip piece passage extending form the upstream end to the downstream end of the tip piece. The downstream end comprises an outlet nozzle. The retainer, the pre-orifice piece, and the tip piece have the same length for each spray tip in the set of spray tips. The pre-orifice piece can vary for each spray tip in the set of spray tips.

DETAILED DESCRIPTION

The present disclosure relates to a spray tip for a fluid sprayer that can be used at low pressures. The spray tip has a body portion and a handle portion. A retainer, a pre-orifice piece, and a tip piece can be positioned in the body portion of the spray tip. A flow path extends through the retainer, the pre-orifice piece, and the tip piece. A fluid can flow through the flow path to be applied to an object. In the spray tip, the spray tip pre-orifice piece is in contact with the tip piece. The pre-orifice piece and the tip piece cooperate to form a turbulating chamber. The turbulating chamber imparts turbulence to the fluid flowing through the turbulating chamber. The turbulence shears the fluid for an even spray fan pattern.

Paint is used here as an example fluid flowing through the sprayer, however it is understood that this is merely one example and that other fluids (e.g., water, oil, stains, finishes, coatings, solvents, etc.) can be sprayed instead of paint.

Figure 1:
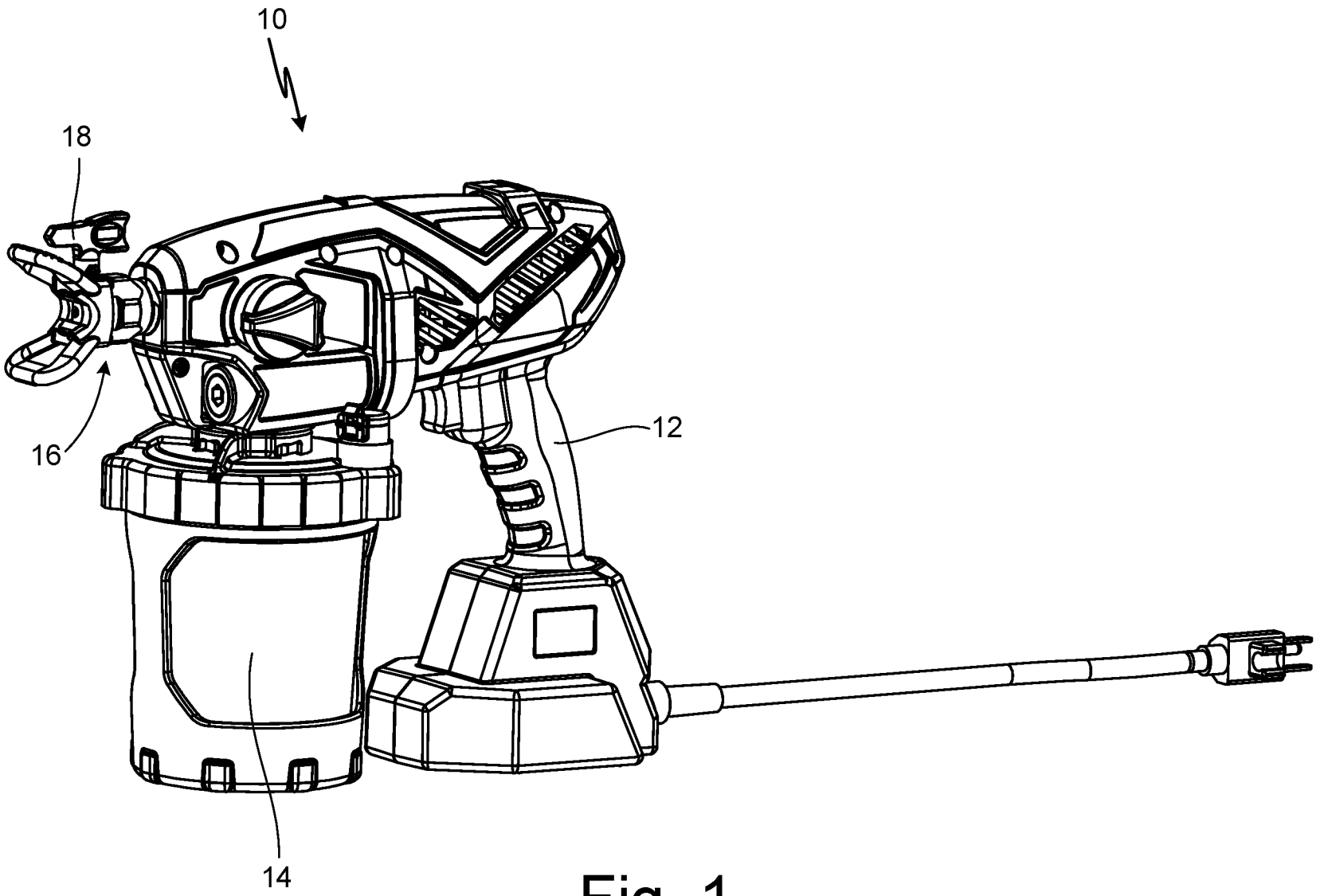
FIG. 1 is a perspective view of a paint sprayer.
Figure 2:
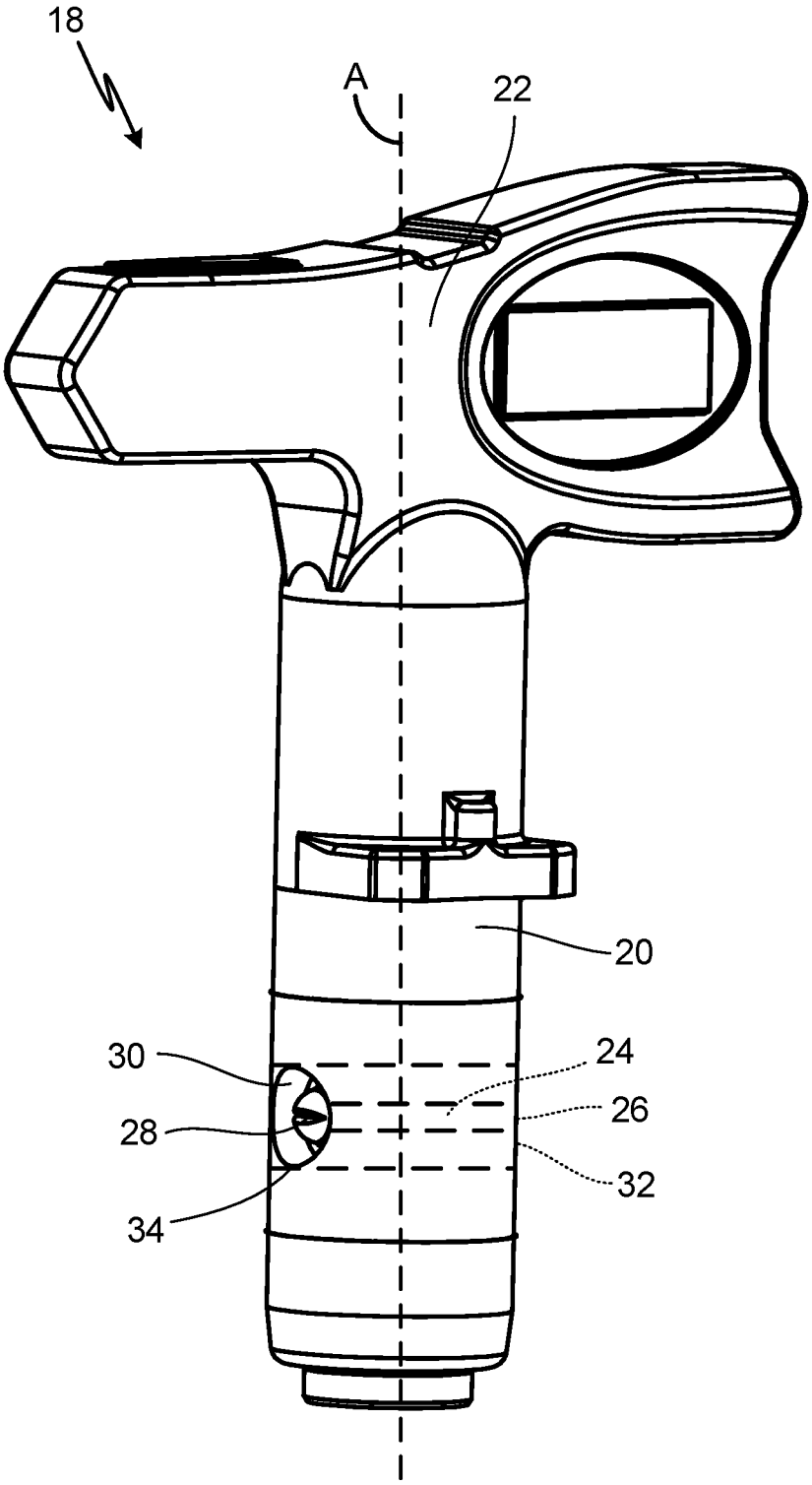
FIG. 2 is a perspective view of a spray tip.

FIG. 1 is a perspective view of sprayer 10. FIG. 2 is a perspective view of spray tip 18. FIGS. 1-2 will be discussed together. Sprayer 10 includes body 12, reservoir 14, nozzle 16, and spray tip 18. Spray tip 18 includes body portion 20, handle portion 22, flow path 24, flow path inlet 26, outlet nozzle 28, aperture 30, aperture inlet 32, and aperture outlet 34.

Sprayer 10 includes body 12 that can be grasped by a user to use sprayer 10. Reservoir 14 is attached to an opening in body 12 of sprayer 10. Reservoir 14 is removable from body 12 to be filled with paint. Reservoir 14 can be a flexible polymer container. Nozzle 16 is also attached to an opening in body 12 of sprayer 10.

FIG. 1 shows sprayer 10 as being a handheld sprayer that can be supported by one hand during spraying. In alternate embodiments, sprayer 10 can be any suitable sprayer. For example, sprayer 10 could be a larger, non-handheld sprayer with a separate reservoir, pump, hose, and gun portion.

Spray tip 18 is positioned in nozzle 16 of sprayer 10. Spray tip 18 can be inserted and removed from nozzle 16. Spray tip 18 imparts a spray pattern to the paint in sprayer 10, and different spray tips 18 can be used to obtain different spray patterns. Further, spray tip 18 can be removed for cleaning. Spray tip 18 includes body portion 20 and handle portion 22. Body portion 20 is a cylindrical portion that is positioned in nozzle 16 of sprayer 10. Body portion 20 is made out of metal, for example stainless steel. Handle portion 22 is positioned on a top end of body portion 20. Handle portion 22 can be grasped by a user to insert and remove spray tip 18 from nozzle 16 of sprayer 10. Handle portion 22 is made out of a polymer. Handle portion 22 is shaped like an arrow to indicate to a user how to position spray tip 18 in nozzle 16 of sprayer 10.

Spray tip 18 further includes flow path 24, flow path inlet 26, and outlet nozzle 28. Flow path 24 is positioned in body portion 20 of spray tip 18 and extends perpendicularly through body portion 20 with respect to axis A of body portion 20. Flow path 24 has flow path inlet 26 and outlet nozzle 28. Flow path inlet 26 is positioned on a first side of body portion 20 of spray tip 18. Outlet nozzle 28 is positioned on a second side of body portion 20 of spray tip 18. Paint can flow through flow path 24 from flow path inlet 26 to outlet nozzle 28.

Flow path 24 of spray tip 18 extends through components positioned in aperture 30 of spray tip 18. Aperture 30 is a cylindrical shaped opening that extends perpendicularly through body portion 20 with respond to axis A. Aperture 30 is coaxially aligned with flow path 24. Aperture 30 has an aperture inlet 32 and an aperture outlet 34. Aperture inlet 32 is positioned on the first side of body portion 20 of spray tip 18. Aperture outlet 34 is positioned on the second side of body portion 20 of spray tip 18. Aperture inlet 32 of aperture 30 is aligned with flow path inlet 26 of flow path 24, and aperture outlet 34 of aperture 30 is aligned with outlet nozzle 28 of flow path 24.

Sprayer 10 includes a pump (not shown) that draws paint from reservoir 14 and pumps the paint under pressure through a flow path in body 12 and nozzle 16 of sprayer 10. The pump can be an electric motorized pump that receives power through a power cord or battery. The paint is pumped into flow path 24 of spray tip 18, through flow path 24 of spray tip 18, and out of outlet nozzle 28. The paint exiting outlet nozzle 28 is exiting sprayer 10 to be applied to an object.

Typically, prior art sprayers have operated at a high pressure. Running sprayers at a high pressure wears out the pump in the sprayer and other components of sprayer. Spray tip 18 allows sprayer 10 to be used at a lower pressure. Using sprayer 10 at a lower pressure extends the life of the pump and other components in sprayer 10. Further, sprayer 10 can be made smaller when lower pressures can be used.

Figure 3A:
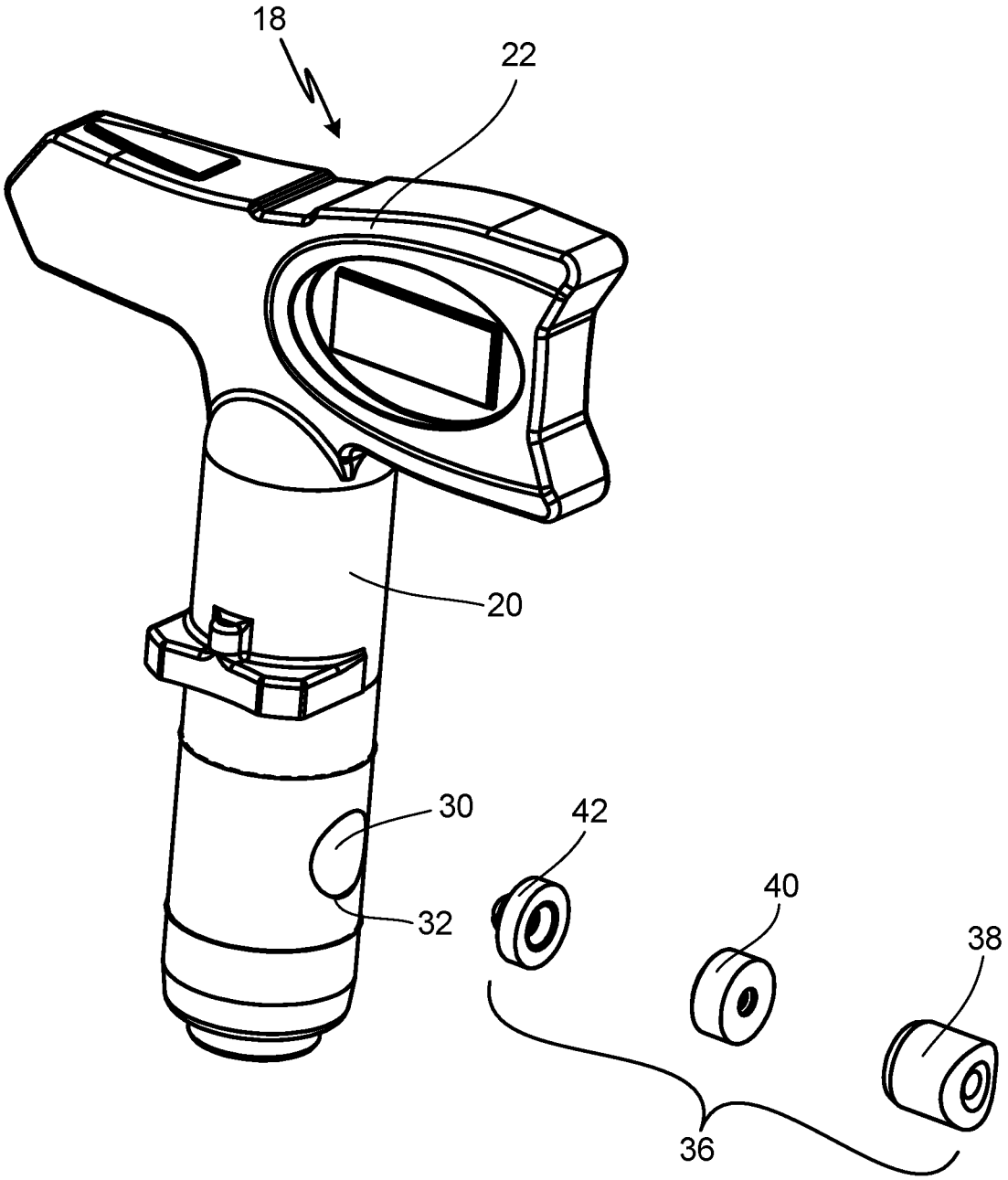
FIG. 3A is an exploded view of a nozzle assembly of the spray tip.
Figure 3B:
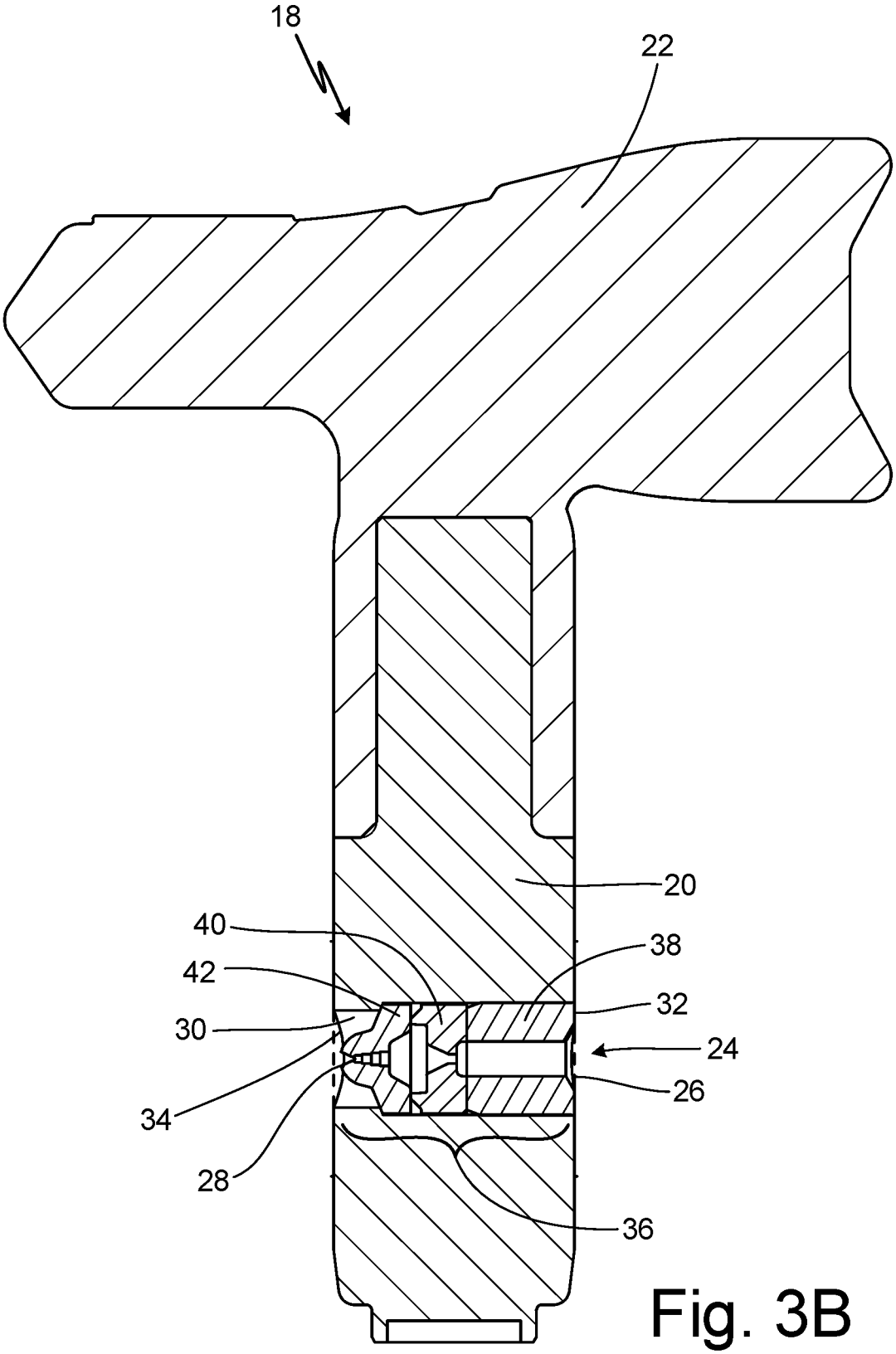
FIG. 3B is a cross-sectional view of the spray tip.

FIG. 3A is an exploded view of nozzle assembly 36 of spray tip 18. FIG. 3B is a cross-sectional view of spray tip 18, taken along line 4-4 of FIG. 2. Spray tip 18 includes body portion 20, handle portion 22, flow path 24, flow path inlet 26, outlet nozzle 28, aperture 30, aperture inlet 32, aperture outlet 34, and multi-piece nozzle assembly 36, which includes retainer 38, pre-orifice piece 40, and tip piece 42.

Spray tip 18 includes cylindrical-shaped body portion 20 and handle portion 22 attached to a top end of body portion 20. Flow path 24 extends through body portion 20 of spray tip 18 and includes flow path inlet 26 and outlet nozzle 28. Outlet nozzle 28 is an exit point for paint flowing through a sprayer (see FIG. 1) and flow path 24 of spray tip 18. Aperture 30 extends through body portion 20 of spray tip 18 and is aligned with flow path 24. Aperture 30 includes aperture inlet 32 and aperture outlet 34.

Nozzle assembly 36 includes retainer 38, pre-orifice piece 40, and tip piece 42. Retainer 38, pre-orifice piece 40, and tip piece 42 are positioned in aperture 30 of spray tip 18. Retainer 38 is positioned adjacent to aperture inlet 32, pre-orifice piece 40 is positioned between retainer 38 and tip piece 42, and tip piece 42 is positioned adjacent to aperture outlet 34. Retainer 38 is made out of a metal, such as stainless steel. Pre-orifice piece 40 and tip piece 42 are made out of a rigid, powder-based material, such as tungsten carbide. Flow path 24 is formed in retainer 38, pre-orifice piece 40, and tip piece 42. Flow path inlet 26 is positioned on a first side of retainer 38, and outlet nozzle 28 is positioned on a second side of tip piece 42.

Spray tip 18 is designed to allow a sprayer to operate at lower pressures. To operate at lower pressures, spray tip 18 has to impart turbulence into the paint flowing through flow path 24 of spray tip 18. Pre-orifice piece 40 and tip piece 42 condition the flow and shape of the spray pattern of the paint flowing through spray tip 18. A turbulating chamber is formed between pre-orifice piece 40 and tip piece 42. The turbulating chamber imparts turbulence to the paint flowing through spray tip 18. The turbulence shears the paint to create an even spray fan pattern.

Figure 4A:
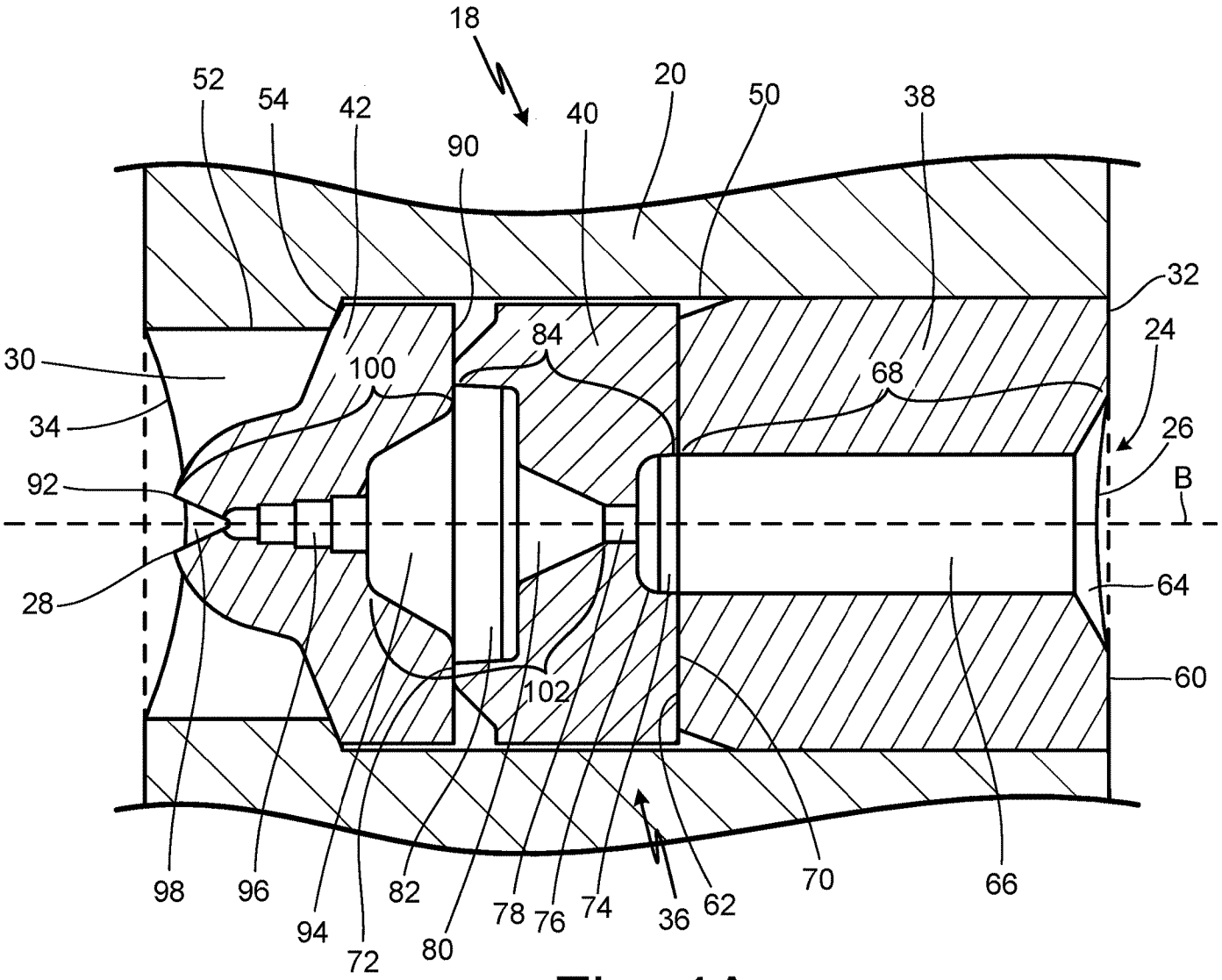
FIG. 4A is a cross-sectional view of the nozzle assembly.
Figure 4B:
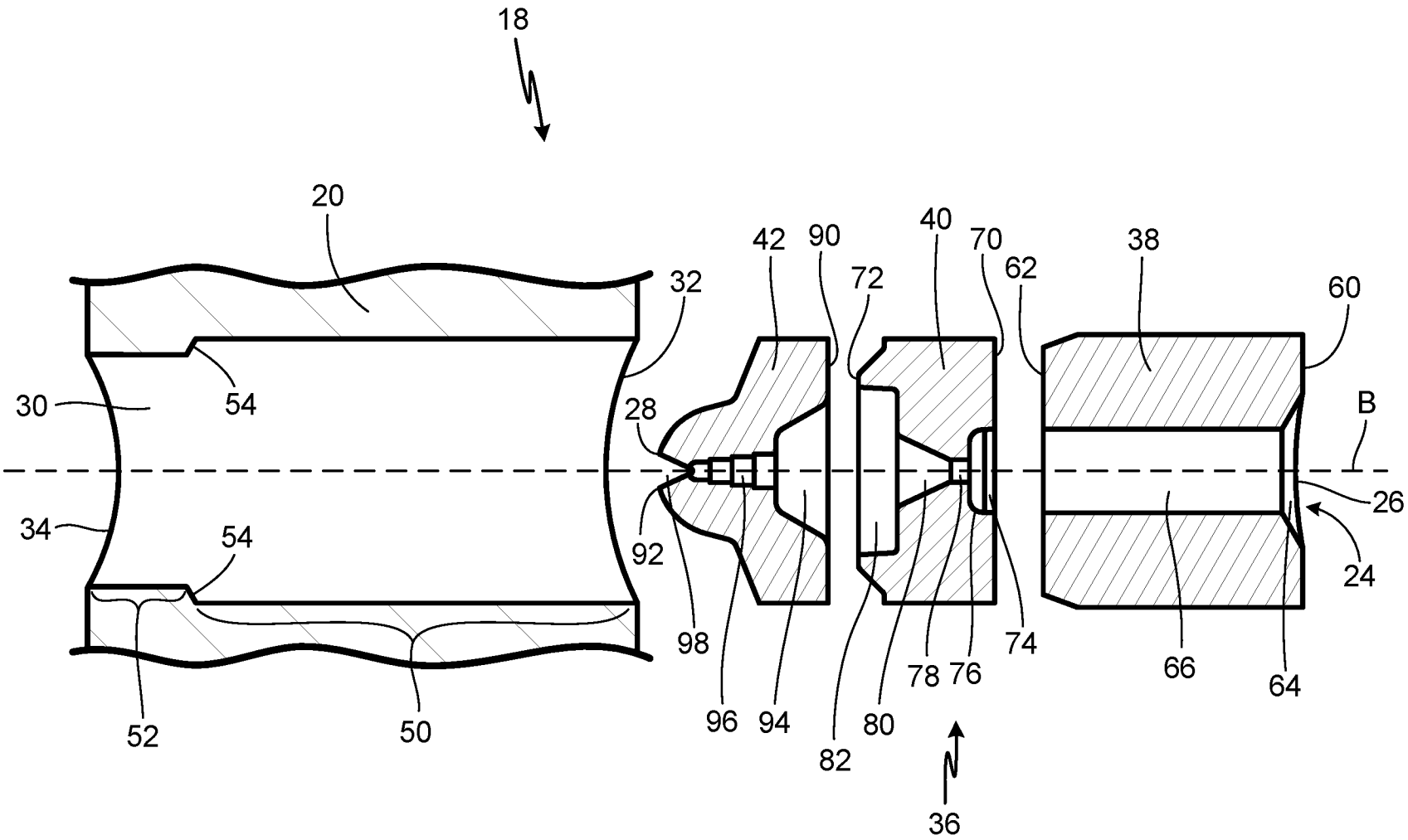
FIG. 4B is an exploded cross-sectional view of the nozzle assembly.

FIG. 4A is a cross-sectional view of nozzle assembly 36, and FIG. 4B is an exploded cross-sectional view of nozzle assembly 36. Spray tip 18 includes body portion 20, flow path 24, flow path inlet 26, outlet nozzle 28, aperture 30, aperture inlet 32, aperture outlet 34, nozzle assembly 36, retainer 38, pre-orifice piece 40, and tip piece 42. Body portion 20 includes first bore 50, second bore 52, and shoulder 54. Retainer 38 includes upstream end 60, downstream end 62, tapered portion 64, channel 66, and retainer passage 68. Pre-orifice piece 40 includes upstream end 70, downstream end 72, recess 74, rounded corners 76, pre-orifice 78, tapered portion 80, expansion channel 82, and pre-orifice piece passage 84. Tip piece 42 includes upstream end 90, downstream end 92, tapered portion 94, stepped channel 96, outlet portion 98, and tip piece passage 100. FIG. 4A also shows expansion chamber 102. FIGS. 4A-4B also show axis B.

Spray tip 18 includes cylindrical-shaped body portion 20 and handle portion 22 attached to a top end of body portion 20. Flow path 24 extends through body portion 20 of spray tip 18 and includes flow path inlet 26 and outlet nozzle 28. Outlet nozzle 28 is an exit point for paint flowing through a sprayer (see FIG. 1) and flow path 24 of spray tip 18. Aperture 30 is formed by first bore 50 and second bore 52, and extends through body portion 20 of spray tip 18 and is aligned with flow path 24. Aperture 30 includes aperture inlet 32 and aperture outlet 34. Aperture 30 is cylindrically shaped.

Nozzle assembly 36 includes retainer 38, pre-orifice piece 40, and tip piece 42. Retainer 38, pre-orifice piece 40, and tip piece 42 are positioned in aperture 30 of spray tip 18. Retainer 38 is positioned adjacent to aperture inlet 32, pre-orifice piece 40 is positioned between retainer 38 and tip piece 42, and tip piece 42 is positioned adjacent to aperture outlet 34. Retainer 38, pre-orifice piece 40, and tip piece 42 are all generally cylindrically shaped and fit into cylindrically shaped aperture 30.

Aperture 30 of body portion 20 of spray tip 18 has first bore 50 adjacent to aperture inlet 32 and second bore 52 adjacent to aperture outlet 34. First bore 50 of aperture 30 has a larger diameter than the diameter of second bore 52. Shoulder 54 is positioned between first bore 50 and second bore 52 of aperture 30. Shoulder 54 is a slanted step between first bore 50 and second bore 52 of aperture 30. Retainer 38, pre-orifice piece 40, and tip piece 42 are positioned in aperture 30 so that an outer cylindrical wall of retainer 38, pre-orifice piece 40, and tip piece 42 fit against first bore 50 of aperture 30. Tip piece 42 abuts shoulder 54 in aperture 30 to hold tip piece 42 in aperture 30.

Retainer 38 is cylindrically shaped, and includes upstream end 60 and downstream end 62. Upstream end 60 of retainer 38 is aligned with aperture inlet 32 of aperture 30 and flow path inlet 26 of flow path 24. Downstream end 62 of retainer 38 abuts pre-orifice piece 40. Retainer 38 includes tapered portion 64 and channel 66. Tapered portion 64 and channel 66 are openings in retainer 38 that form a portion of flow path 24 through retainer 38. Tapered portion 64 has a first side that is aligned with upstream end 60 of retainer 38 and a second side that is positioned adjacent to channel 66. Tapered portion 64 is a frustoconical shaped opening with a larger diameter at upstream end 60 that tapers to a smaller diameter at channel 66. Channel 66 has a first side that is positioned adjacent to tapered portion 64 and a second side that is aligned with downstream end 62 of retainer 38. Channel 66 is a cylindrically shaped opening extending between tapered portion 64 and downstream end 62. Tapered portion 64 and channel 66 form retainer passage 68 in retainer 38. Retainer passage 68 extends from upstream end 60 to downstream end 62 of retainer 38.

Pre-orifice piece 40 is cylindrically shaped, and includes upstream end 70 and downstream end 72. Upstream end 70 of pre-orifice piece 40 abuts retainer 38. Downstream end 72 of pre-orifice piece 40 abuts tip piece 42. Pre-orifice piece 40 includes recess 74 with rounded corners 76, pre-orifice 78, tapered portion 80, and expansion channel 82. Recess 74, pre-orifice 78, tapered portion 80, and expansion channel 82 are openings in pre-orifice piece 40 that form a portion of flow path 24 through pre-orifice piece 40. Recess 74 has a first side that is aligned with upstream end 70 of pre-orifice piece 40 and a second side that is positioned adjacent to pre-orifice 80. Recess 74 is a U-shaped opening that has rounded corners 76. Rounded corners 76 are positioned adjacent to the second side of recess 74 and are curved towards pre-orifice 78. Pre-orifice 78 has a first side that is positioned adjacent to recess 74 and a second side that is positioned adjacent to tapered portion 80. Pre-orifice 78 is a cylindrically shaped opening extending between recess 74 and tapered portion 80. Tapered portion 80 has a first side positioned adjacent to pre-orifice 78 and a second side positioned adjacent to expansion channel 82. Tapered portion 80 is a frustoconical shaped opening with a smaller diameter at pre-orifice 78 that tapers to a larger diameter at expansion channel 82. Expansion channel 82 has a first side positioned adjacent to tapered portion 80 and a second side aligned with downstream end 72 of pre-orifice piece 40. Expansion channel 82 is a cylindrically shaped opening extending between tapered portion 80 and downstream end 72 of pre-orifice piece 40. In the embodiment shown in FIGS. 4A-4B, expansion channel 82 has a constant diameter. In alternate embodiments, expansion channel 82 can have a diameter that gradually increased in a downstream direction. Recess 74, pre-orifice 78, tapered portion 80, and expansion channel 82 form pre-orifice piece passage 84 through pre-orifice piece 40. Pre-orifice piece passage 84 extends from upstream end 70 to downstream end 72 of pre-orifice piece 40.

Tip piece 42 is cylindrically shaped with a domed tip extending in an downstream direction. Tip piece 42 includes upstream end 90 and downstream end 92. Upstream end 90 of tip piece 42 abuts pre-orifice piece 40. Downstream end 92 of tip piece 42 is aligned with aperture outlet 34 of aperture 30 and outlet nozzle 28 of flow path 24. Tip piece 42 includes tapered portion 94, stepped channel 96, and outlet portion 98. Tapered portion 94, stepped channel 96, and outlet portion 98 are openings in tip piece 42 that form a portion of flow path 24 through tip piece 42. Tapered portion 94 has a first side that is aligned with upstream end 60 of tip piece 42 and a second side that is positioned adjacent to stepped channel 96. Tapered portion 94 is a frustoconical shaped opening with a larger diameter at upstream end 90 that tapers to a smaller diameter at stepped channel 96. In alternate embodiments, tapered portion 94 can have a constant diameter. Stepped channel 96 has a first side that is positioned adjacent to tapered portion 94 and a second side that is positioned adjacent to outlet portion 98. Stepped channel 96 includes a number of cylindrically shaped openings with diameters that get progressively smaller between tapered portion 94 and outlet portion 98. In an alternate embodiment, stepped channel 96 can be frustoconical in shape, tapering in the downstream direction. Outlet portion 98 has a first side positioned adjacent to stepped channel 96 and a second side aligned with downstream end 92 of tip piece 42. Outlet portion 98 is a frustoconical shaped opening with a smaller diameter at stepped channel 96 that tapers to a larger diameter at downstream end 92. Outlet portion 98 is cut into the domed portion of tip piece 42. Tapered portion 94, stepped channel 96, and outlet portion 98 form tip piece passage 100 in tip piece 42. Tip piece passage 100 extends from upstream end 90 to downstream end 92 of tip piece 42.

Expansion chamber 102 is formed between pre-orifice piece 40 and tip piece 42. Expansion chamber 102 include tapered portion 80 and expansion channel 82 in pre-orifice piece 40 and tapered portion 94 in tip piece 42. Expansion chamber 102 will impart turbulence to paint flowing through expansion chamber 102.

Retainer 38, pre-orifice piece 40, and tip piece 42 are positioned in aperture 30. Retainer 38 is press-fit into aperture 30 to hold pre-orifice piece 40 and tip piece 42 in aperture 30. Flow path 24 extends through retainer 38, pre-orifice piece 40, and tip piece 42 and is formed in the openings of retainer 38, pre-orifice piece 40, and tip piece 42. Flow path inlet 26 is positioned at upstream end 60 of retainer 38, and outlet nozzle 28 is positioned at downstream end 92 of tip piece 42. Flow path 24 extends through tapered portion 64 and channel 66 of retainer 38; through recess 74, pre-orifice 78, tapered portion 80, and expansion channel 82 of pre-orifice piece 40; and through tapered portion 94, stepped channel 96, and outlet portion 98 of tip piece 42.

Paint will enter flow path 24 at flow path inlet 26. The paint will enter tapered portion 64 of retainer 38 and will flow through to channel 66. Channel 66 of retainer 38 is aligned with and has the same diameter as recess 74 of pre-orifice piece 40. The paint flowing through flow path 24 will flow from channel 66 of retainer 38 to recess 74 of pre-orifice piece 40. The paint will then flow through recess 74 to pre-orifice 78. Rounded corners 76 of recess 74 prevent paint from getting trapped in recess 74 and will help to move the paint in recess 74 to pre-orifice 78. Pre-orifice 78 is the narrowest portion of flow path 24. The paint will then flow from pre-orifice 78 to tapered portion 80, and from tapered portion 80 to expansion channel 82. Tapered portion 80 and expansion channel 82 form a portion of expansion chamber 102.

Expansion channel 82 of pre-orifice piece 40 has a larger diameter than tapered portion 94 of tip piece 42. Upstream end 90 of tip piece 42 forms a flat and orthogonal wall in flow path 24. Paint from expansion channel 82 of pre-orifice piece 40 will flow into tapered portion 94 of tip piece 42. Some paint from expansion channel 82 of pre-orifice piece 40 will flow against upstream end 90 of tip piece 42 before entering tapered portion 94. Tapered portion 94 forms a portion of expansion chamber 102. The paint in tapered portion 42 will flow through stepped channel 96 and out of outlet portion 98. The paint flowing out of outlet portion 98 will be in an atomized spray fan and can be applied to an object.

Pre-orifice 78 in pre-orifice piece 40 and upstream side of outlet portion 98 of tip piece 42 are the narrowest sections of flow path 26. The openings positioned between the pre-orifice 78 in pre-orifice piece 40 and outlet portion 98 of tip piece 42 induce turbulence in the flow of paint through pre-orifice piece 40 and tip piece 42. These openings include tapered portion 80 and expansion channel 82 in pre-orifice piece 40, and tapered portion 94 and stepped channel 96 in tip piece 42. The turbulence shears the fluid for an even spray fan pattern.

Further, the portion of upstream end 90 of tip piece 42 that is positioned in flow path 24 will also impart turbulence into the paint flowing from expansion channel 82 of pre-orifice piece 40 to tapered portion 94 of tip piece 42. Expansion channel 82 of pre-orifice piece 40 is sized to have a larger diameter than tapered portion 94 of tip piece 42. This means that the contained volume of expansion channel 82 of pre-orifice piece 40 is partially defined in the downstream direction by upstream end 90 of tip piece 42. Upstream end 90 of tip piece 42 is within flow path 24 and creates an abrupt annular construction in flow path 24. This creates turbulence in flow path 24. Further, this allows for flush interfacing surfaces of downstream end 72 of pre-orifice piece 40 and upstream end 90 of tip piece 42 to maintain a seal between these pieces and prevent leakage outside of flow path 24.

Pre-orifice 98 is sized and positioned to create resistance in flow path 24 to create a spray fan pattern. Pre-orifice 98 can have different sizes and positions in order to accommodate different types of paint or other fluids flowing through spray tip 18. Two alternate embodiments showing different sizes and positions for pre-orifice 98 are shown in FIGS. 5 and 6.

Figure 5:
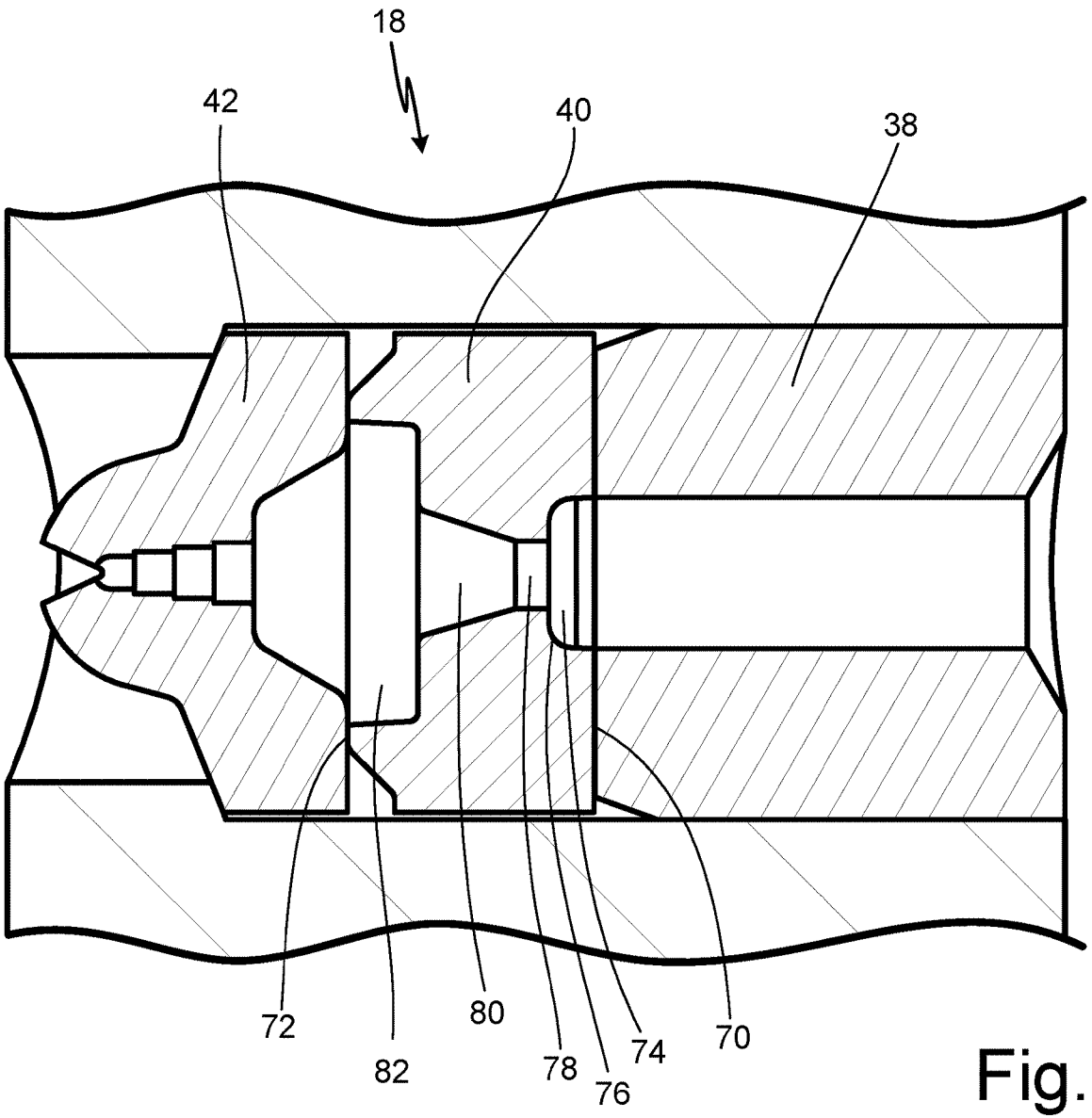
FIG. 5 is a cross-sectional view of a first alternate embodiment of the nozzle assembly.
Figure 6:
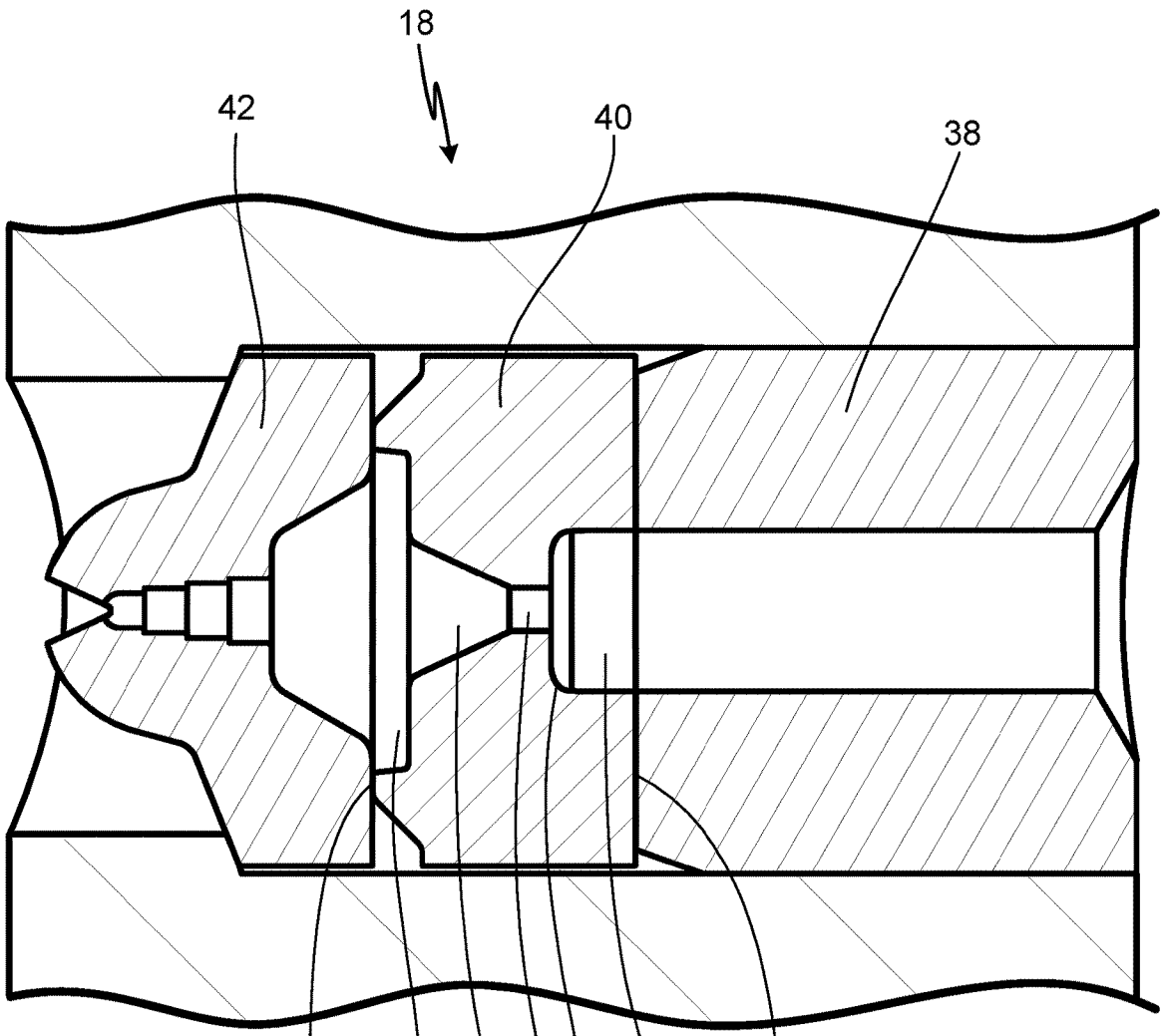
FIG. 6 is a cross-sectional view of a second alternate embodiment of the nozzle assembly.

FIG. 5 is a cross-sectional view of a first alternate embodiment of nozzle assembly 36. Spray tip 18 includes nozzle assembly 36, retainer 38, pre-orifice piece 40, and tip piece 42. Pre-orifice piece 40 includes upstream end 70, downstream end 72, recess 74, rounded corners 76, pre-orifice 78, tapered portion 80, and expansion channel 82.

Spray tip 18 shown in FIG. 5 has generally the same structure and design as spray tip 18 shown in FIGS. 4A-4B. Pre-orifice piece 40 differs from that shown in FIGS. 4A-4B in that pre-orifice 78 and tapered portion 80 have different sizes. As shown in FIG. 5, both pre-orifice 78 and tapered portion 80 of pre-orifice piece 40 have larger diameters than those shown in FIGS. 4A-4B. The position of pre-orifice 78 and tapered portion 80 has not changed.

Increasing the diameter of pre-orifice 78 and tapered portion 80 of pre-orifice piece 40 alters the spray pattern of paint flowing through spray tip 18. This can be done to accommodate different paint types or other fluids flowing through spray tip 18.

FIG. 6 is a cross-sectional view of a second alternate embodiment of nozzle assembly 36. Spray tip 18 includes nozzle assembly 36, retainer 38, pre-orifice piece 40, and tip piece 42. Pre-orifice piece 40 includes upstream end 70, downstream end 72, recess 74, rounded corners 76, pre-orifice 78, tapered portion 80, and expansion channel 82.

Spray tip 18 shown in FIG. 5 has generally the same structure and design as spray tip 18 shown in FIGS. 4A-4B. Pre-orifice piece 40 differs from that shown in FIGS. 4A-4B in that pre-orifice 78 and tapered portion 80 are positioned closer to tip piece 42. As shown in FIG. 5, recess 74 of pre-orifice piece 40 has been made longer and expansion channel 82 of pre-orifice piece 40 has been made shorter than that shown in FIGS. 4A-4B. The size of pre-orifice 78 and tapered portion 80 have not changed.

Increasing the length of recess 74 of pre-orifice piece 40 and shortening the length of expansion channel 82 of pre-orifice piece 40 alters the spray pattern of paint flowing through spray tip 18 by shortening the space between pre-orifice 98 and tip piece 42. This can be done to accommodate different paint types or other fluids flowing through spray tip 18.

As shown in FIGS. 4A-6, changing the size and position of pre-orifice 98 can alter the turbulence that is created in spray tip 18. Different spray tips 18 can be designed with different degrees of turbulence to accommodate different types of paints and other fluids. Further, different degrees of turbulence can create different fan patterns for different jobs. Modifying the size and position of pre-orifice 98 to alter the turbulence and fan pattern of the fluid flowing through spray tip 18 allows for easy manufacture of spray tip 18. Different spray tips 18 can use the same body portions 20, handle portions 22, retainers 38, and tip pieces 42. The only part that has to be altered to vary the turbulence and fan pattern is pre-orifice piece 40. This allows sprayers to be designed to accommodate the one size spray tip 18, while also allowing for flexibility in the turbulence and fan pattern of paint flowing through spray tip 18.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A spray tip comprising:

a body portion with an aperture extending through the body portion from an aperture inlet to an aperture outlet;

a handle portion attached to the body portion, the handle portion configured to rotate the body portion;

a retainer comprised of a first material with an upstream end and a downstream end positioned in the aperture of the body portion, wherein the retainer includes a retainer passage extending from the upstream end to the downstream end of the retainer a pre-orifice piece comprised of a second material with an upstream end and a downstream end positioned in the aperture of the body portion, wherein the pre-orifice piece includes a pre-orifice piece passage extending from the upstream end to the downstream end of the pre-orifice piece, wherein the pre-orifice piece passage being defined by an at least partially cylindrical recess on the upstream end, an expansion chamber portion on the downstream end, and a pre-orifice located downstream of the at least partially cylindrical recess and upstream of the expansion chamber portion, and wherein the pre-orifice is a narrowest portion of the pre-orifice piece passage, and wherein the at least partially cylindrical recess includes a cylindrical portion extending into the pre-orifice piece from the upstream end; and a tip piece with an upstream end and a downstream end positioned in the aperture of the body portion, wherein the tip piece includes a tip piece passage extending form the upstream end to the downstream end of the tip piece, and wherein the downstream end comprises an outlet nozzle;

wherein the retainer passage is aligned with the at least partially cylindrical recess of the pre-orifice piece.

2. The spray tip of claim 1, wherein the upstream end of the retainer is aligned with the aperture inlet, wherein the upstream end of the pre-orifice piece is adjacent to the downstream end of the retainer, wherein the upstream end of the tip piece is adjacent to the downstream end of the pre-orifice piece, and the downstream end of the tip piece is aligned with the aperture outlet.

3. The spray tip of claim 1, wherein the retainer passage comprises:

a first tapered portion with an upstream end aligned with the upstream end of the retainer; and a channel with an upstream end adjacent to a downstream end of the first tapered portion and a downstream end aligned with the downstream end of the retainer.

4. The spray tip of claim 1, wherein a diameter of the retainer passage is the same as a diameter of the cylindrical portion of the at least partially cylindrical recess of the pre-orifice piece.

5. The spray tip of claim 3, wherein the expansion chamber portion in the pre-orifice piece passage of the pre-orifice piece comprises:

a second tapered section with an upstream end adjacent to a downstream end of the pre-orifice; and an expansion channel with an upstream end adjacent to a downstream end of the second tapered section and a downstream end aligned with the downstream end of the pre-orifice piece.

6. The spray tip of claim 5, wherein the tip piece passage comprises:

an expansion chamber portion on the upstream end of the tip piece passage;

wherein the expansion chamber portion of the pre-orifice piece passage and the expansion chamber portion of the tip piece passage form an expansion chamber between the pre-orifice piece and the tip piece.

7. The spray tip of claim 6, wherein the expansion chamber portion of the tip piece passage includes a third tapered portion with an upstream end aligned with the upstream end of the tip piece, and wherein the tip piece passage further comprises:

a stepped channel with an upstream end adjacent to a downstream end of the third tapered portion; and an outlet portion with an upstream end adjacent to a downstream end of the stepped channel and a downstream end aligned with the downstream end of the tip piece.

8. The spray tip of claim 1, wherein the at least partially cylindrical recess has rounded corners at a downstream end of the at least partially cylindrical recess and formed at an intersection between the cylindrical portion and a wall narrowing to the pre-orifice.

9. The spray tip of claim 1, wherein the retainer is made out of stainless steel and the pre-orifice piece and the tip piece are made out of tungsten carbide.

10. The spray tip of claim 1, wherein the first material and the second material are different materials.

11. A spray tip comprising:

a body portion with an aperture extending through the body portion from an aperture inlet to an aperture outlet;

a handle portion attached to the body portion, the handle portion configured to rotate the body portion;

a retainer comprised of a first material with an upstream end and a downstream end positioned in the aperture of the body portion, wherein the retainer includes a retainer passage extending from the upstream end to the downstream end of the retainer;

a pre-orifice piece comprised of a second material with an upstream end and a downstream end positioned in the aperture of the body portion, wherein the pre-orifice piece includes a pre-orifice piece passage extending from the upstream end to the downstream end of the pre-orifice piece, wherein the pre-orifice piece passage includes an at least partially cylindrical recess with an upstream end aligned with the upstream end of the pre-orifice piece and a downstream end aligned with the upstream end of the pre-orifice piece passage, and wherein the pre-orifice piece passage further includes an expansion chamber portion with a downstream end aligned with the downstream end of the pre-orifice piece; and a tip piece with an upstream end and a downstream end positioned in the aperture of the body portion, wherein the tip piece includes a tip piece passage extending from the upstream end to the downstream end of the tip piece, wherein the downstream end comprises an outlet nozzle, and wherein the tip piece passage includes an expansion chamber portion with an upstream end aligned with the upstream end of the tip piece;

wherein the diameter of the expansion chamber portion of the pre-orifice piece passage at the downstream end is larger than the diameter of the expansion chamber portion of the tip piece passage at the upstream end;

wherein the at least partially cylindrical recess includes a cylindrical portion extending into the pre-orifice piece from the upstream end of the pre-orifice piece; and wherein the retainer passage is disposed adjacent to and has the same diameter as the cylindrical portion of the at least partially cylindrical recess.

12. The spray tip of claim 11, wherein the upstream end of the retainer is aligned with the aperture inlet, wherein the upstream end of the pre-orifice piece is adjacent to the downstream end of the retainer, wherein the upstream end of the tip piece is adjacent to the downstream end of the pre-orifice piece, and the downstream end of the tip piece is aligned with the aperture outlet.

13. The spray tip of claim 11, wherein the upstream end of the tip piece creates a wall between the expansion chamber portion of the pre-orifice piece passage and the expansion chamber portion of the tip piece passage.

14. The spray tip of claim 13, wherein the wall is flat and orthogonal to a flow path through the expansion chamber portion of the pre-orifice piece passage and the expansion chamber portion of the tip piece passage to impart turbulence to the fluid flowing through the spray tip.

15. The spray tip of claim 11, wherein the expansion chamber portion in the pre-orifice piece passage of the pre-orifice piece includes a first tapered section with an upstream end adjacent to a downstream end of the pre-orifice, and an expansion channel with an upstream end adjacent to a downstream end of the first tapered section and a downstream end aligned with the downstream end of the pre-orifice piece, and wherein the expansion chamber portion of the tip piece passage includes a second tapered portion with an upstream end aligned with the upstream end of the tip piece.

16. The spray tip of claim 15, wherein:

the retainer passage comprises:

a third tapered portion with an upstream end aligned with the upstream end of the retainer; and a channel with an upstream end adjacent to a downstream end of the third tapered portion and a downstream end aligned with the downstream end of the retainer;

the pre-orifice piece passage comprises:

a pre-orifice with an upstream end adjacent to the downstream end of the at least partially cylindrical recess and a downstream end adjacent to an upstream end of the first tapered portion; and the tip piece passage comprises:

a stepped channel with an upstream end adjacent to a downstream end of the second tapered portion; and an outlet portion with an upstream end adjacent to a downstream end of the stepped channel and a downstream end aligned with the downstream end of the tip piece.

17. A set of spray tips, each spray tip comprising:

a body portion with an aperture extending through the body portion from an aperture inlet to an aperture outlet;

a handle portion attached to the body portion, the handle portion configured to rotate the body portion;

a retainer comprised of a first material with an upstream end and a downstream end positioned in the aperture of the body portion, wherein the retainer includes a retainer passage extending from the upstream end to the downstream end of the retainer;

a pre-orifice piece comprised of a second material with an upstream end and a downstream end positioned in the aperture of the body portion, wherein the pre-orifice piece includes a pre-orifice piece passage extending from the upstream end to the downstream end of the pre-orifice piece; wherein the pre-orifice piece passage is defined by an at least partially cylindrical recess on the upstream end of the pre-orifice piece and expansion chamber on the downstream end of the pre-orifice piece; wherein the at least partially cylindrical recess includes a cylindrical portion extending into the pre-orifice piece from the upstream end of the pre-orifice piece; and a tip piece with an upstream end and a downstream end positioned in the aperture of the body portion, wherein the tip piece includes a tip piece passage extending form the upstream end to the downstream end of the tip piece, and wherein the downstream end comprises an outlet nozzle;

wherein the retainer, the pre-orifice piece, and the tip piece each have a standard length that is the same for each spray tip in the set of spray tips;

wherein the pre-orifice piece can vary for each spray tip in the set of spray tips; and wherein a length of the retainer passage is greater than a length of the pre-orifice piece passage.

18. The set of spray tips of claim 17, wherein each pre-orifice piece passage comprises:

a recess with an upstream end aligned with the upstream end of the retainer;

a pre-orifice with an upstream end adjacent to a downstream end of the recess;

a tapered portion with an upstream end adjacent to a downstream end of the pre-orifice; and an expansion channel with an upstream end adjacent to a downstream end of the tapered portion and a downstream end aligned with the upstream end of the tip piece.

19. The set of spray tips of claim 18, wherein the width of the pre-orifice and the tapered portion can vary for each spray tip in the set of spray tips.

20. The set of spray tips of claim 18, wherein a length of the recess and a length of the expansion channel can vary for each spray tip in the set of spray tips.

* * * * *